US008708437B2

(12) United States Patent
Kushner et al.

(10) Patent No.: US 8,708,437 B2
(45) Date of Patent: Apr. 29, 2014

(54) INK JET MULTI-COLOR PRINTING SYSTEM

(76) Inventors: David S. Kushner, Great Neck, NY (US); Charles R. Hoffman, III, New York, NY (US); Rajendra C. Joshi, Jersey City, NJ (US); Robert Manning, New York, NY (US)

( * ) Notice: Subject to any disclaimer, the term of this patent is extended or adjusted under 35 U.S.C. 154(b) by 996 days.

(21) Appl. No.: 12/441,745

(22) PCT Filed: Sep. 18, 2007

(86) PCT No.: PCT/US2007/078709

§ 371 (c)(1),
(2), (4) Date: Dec. 8, 2009

(87) PCT Pub. No.: WO2008/036620

PCT Pub. Date: Mar. 27, 2008

(65) Prior Publication Data

US 2010/0103207 A1 Apr. 29, 2010

Related U.S. Application Data

(60) Provisional application No. 60/845,682, filed on Sep. 19, 2006, provisional application No. 60/913,674, filed on Apr. 24, 2007.

(51) Int. Cl.
*B41J 29/38* (2006.01)

(52) U.S. Cl.
USPC ..... 347/5; 347/14; 347/105

(58) Field of Classification Search
USPC ..... 347/16, 105, 38
See application file for complete search history.

(56) References Cited

U.S. PATENT DOCUMENTS

| | | | | |
|---|---|---|---|---|
| 3,600,750 | A * | 8/1971 | Stroszynski | 425/113 |
| 7,722,163 | B2 * | 5/2010 | Sheahan et al. | 347/54 |
| 2003/0169324 | A1 * | 9/2003 | Kushner et al. | 347/105 |
| 2005/0185009 | A1 * | 8/2005 | Claramunt et al. | 347/16 |
| 2006/0162586 | A1 * | 7/2006 | Fresener et al. | 101/115 |

OTHER PUBLICATIONS

Welcome to EasyDTG.com—FastINK textile ink for your Fast T-Jet Printer! http://easydtg.com/fast_ink.html—Direct to Garment (DTG) Printing website which sells Fastlnk Copyright 2007.*

* cited by examiner

*Primary Examiner* — Julian Huffman
*Assistant Examiner* — Sharon A Polk
(74) *Attorney, Agent, or Firm* — Lackenbach Siegel, LLP

(57) ABSTRACT

A system for optimizing RGB digital color images to print a high speed textile conveyed substrate using a series of modular single color specific ink jet print engines. The system mounts a rotary screen upstream and in operable combination with the ink jet print engines consequentially providing a broad array of printing modes and effects. Each print engine extracts print engine specific instructions from a server to provide a sequential cascade of printings to print the desired image. Internetworking extends operable control to remote client and expands RGB image archive to galleries of the World Wide Web. Present commercial rotary screen machines can be retrofitted to utilize the present system.

12 Claims, 17 Drawing Sheets

REMOTE PRINT/COLOR CONTROL (MIX CURVES)

A–SCARLET SET
B–GOLDEN YELLOW & ORANGE SET
C–RED SET (HUE CURVES)

2 COLOR INK SYSTEMS

INK JET MULTI-COLOR PRINTING SYSTEM

PRIOR RELATED APPLICATIONS

This application claims priority to provisional patent application Ser. No. 60/845,682, filed Sep. 19, 2006, Ser. No. 60/913,674, filed Apr. 24, 2007, and PCT patent application Serial No. PCT/US2007/078709, filed Sep. 18, 2007 and incorporates these applications in their entireties herein by reference thereto.

BACKGROUND OF THE INVENTION

1. Field of the Invention

The present invention relates to improvements in the ink jet color printing and multi-color ink jet technology. The present invention relates to an apparatus and system for printing on large elongate printable substrates, including but not limited to textiles.

2. Background and Discussion of the Prior Art

Industrial printing of textiles began in the 18th century and for about two hundred years intaglio copper roller printing was the preferred method of printing. From the 1890's through the 20th century, in the USA, the Rice-Barton copper roller printer was the main industrial production device. Rotary screen-printing machines replaced the copper roller printers in the late 20th century as the main industrial textile printing method. Today the majority of the worlds printed textiles are produced with rotary screens. Most of the world's printed textiles are produced by thousands of industrial printing machines each with fabric spreading, and tensioning devices, fabric transport belt with belt washer, fabric dryers, and twelve or so rotary screen printing stations mounted across and synchronized with the belt. Engraving of rotary screens is a barrier to low cost, quick, and short run production. Finishing after printing requires resources such as space, energy, water, and environmental protection.

Ink jet textile printing has been practiced in studios and small shops since the 1990's, but production has not yet reached full industrial dimension. Until recently ink jet has been used for short runs, for high couture, art production, one-of-a-kind high-end items, and rapid pre-production marketing samples.

Until now it has been a prevailing opinion that the introduction of ink jet printing would be disruptive to traditional printing and that new simple finishing methods would arise that would allow small, high cost, low speed, digital print production runs to happen close to the end user of the textile and thus eliminate the low cost, high speed, traditional textile print processor. So far this has not happened. This invention makes it possible to incorporate digital printing into the traditional production process in a non-disruptive and synergistically dynamic manner.

Centuries of industrial textile production have resulted in a cost conscious, market oriented, worldwide textile industry. Studio print production of digital imagery has shown the value of digital printing, it's ability to reproduce fine gradients, photographs and any digital image rapidly and routinely on fabric. Meanwhile the rise of the Internet and the World Wide Web, along with digital imaging means has transformed the world's images into digital creations, easily available for direct digital printing. This invention makes a bridge from the digital imaging world to the industrial textile-printing world.

It has been shown by Hewlett-Packard ("HP"), Agfa and others that it is possible to print industrial webs with fixed, full-width print engines, where the ink jet head does not move on a shuttle back and forth across the substrate but remains stationary. This type of print engine uses arrays of print head dies with many thousands of ink jet nozzles and has a printing speed of industrial magnitude.

Since the rise of the Internet and also the replacement of silver based photography by digital photography and the widespread use of digital scanners, most images originate as, or are converted into RGB images. In the days before the widespread use of these RGB digital images, most images were printed as multi-color separations usually CMYB images and in the early days of digital printing special types of digital files were used that incorporated images as multi-color (channel) separations such as the Scitex image format.

The art desires a practical industrial system for printing elongate conveyed fibrous substrates, such as textiles, in a broad range of printing effects in art quality printed images. The art desires a multi-color printing system for elongate conveyed printable substrates, particularly including textiles, which system is high speed and commercially practicable, and yet faithfully produces an art quality image, such as a digital RGB image. The present invention provides a solution to these art needs.

SUMMARY OF THE INVENTION

A multi-color ink jet printing system is disclosed wherein a digitally formatted RGB image is directly utilized without a CMY transformation. The system has a server that provides instructions to a plurality or array of ink jet print engines. Each print engine extracts from the server the instructions component specific to that print engine. A slice-by-slice print engine specific set of instructions is cascaded downstream across the array of print engines.

In a most preferred embodiment, the array of print engines is used in combination with at least one rotary printing station, such as a rotary screen printer. The rotary screen printer is disposed upstream of the print engines. This combination achieves a level of high-speed art quality textile printing with a broad range of printing effects not achievable by present systems. In a further aspect, the present invention contemplates retrofitting present rotary screen textile printing machines to include in operable combination the array of ink jet print engines. An array of at least 8 and preferably 12 ink jet print engines is a most preferred embodiment of the invention.

The present invention also contemplates on-the-fly printing adjustments and improvements, wherein a photodiode digitally copies a first printed image and conveys, in a secondary controller, a set of modified or supplemental instructions to each of the respective print engines and the rotary screen printer. The supplemental printing is repeated until the produced image has the desired aesthetic of the desired image. This system also minimizes job set-up time and downtime. The present system provides in effect a 24/7 operation.

In another aspect, the present invention permits printing conveyed substrates with synchronization or raster markings or other print control indicia to be directly printed on the washable conveyor belt. This eliminates substrate impairment and loss. This provides a further improvement in that the belt is a more dimensionally stable surface for uniform markings. The washed belt is then ready to receive a new series of print registration markings or like indicia.

The present system permits online print head calibrations. The present system also permits use of non-uniform substrate portions for print head calibration, thereby reducing the substrate material loss and concomitants costs.

This invention in several respects provides improvements in the ink jet technology disclosed in present applicants U.S.

Pat. No. 6,588,879; U.S. Pat. No. 6,736,485; U.S. Pat. No. 6,834,934 and U.S. Pat. No. 6,834,935 commonly assigned to Supersample Corporation (the "Super Sample patents"), and complementary improvements in the multi-color printing technologies disclosed in US2005/0185009; US2005/0079137; U.S. Pat. No. 7,021,738; US2006/0120787; US2006/0109291; and US2004/0075709; assigned to Hewlett-Packard Development Company L.P. (the "Hewlett-Packard patents and patent applications"). The Super Sample patents and the Hewlett-Packard patents and patent applications are incorporated herein in their respective entireties by reference thereto.

The prior art tendency to use multi-channel CMYB images persists, such as disclosed in US 2005/0185009. The multi-color image is composed of a number of basic color images, e.g. using CMY or CMYB with C=cyan, M=magenta, Y=yellow, B=black which are individually printed in an aligned manner.

The prior art ink jet printing systems generally process each RGB pixel by deconstructing the pixel into color saturation and black components. There is a correlation of the X-Y printing specific color coordinating positions with an RGB pixel position. The specific print job is set-up off-line. The prior art systems selects the inks and/or sub-mixtures and sets them on the hue line and black and dark spaces, while perceiving the results.

The prior art CMYK four-color standard is in widespread and particularly in the graphic arts. Turquoise is referred to as "cyan", and K is black. Some commercial printing systems use six colors CMYKlclm where lc is light cyan and lm is light magenta or pink. Another six color system is the Hexachrome color suite CMYKOG, where O is orange and G is green. Yet another six-color system is the CMYKBO used by the Regianni Dream ink jet (B is blue). The term "CMY transformation", as used hereinbefore and hereinafter broadly refers to any cyan, magenta and yellow color transformation from an RGB image.

In general, the more colors in a printing battery, the better the printed image. The Yuhan-Kimberly Clark/DTP (Colorspan) printer has a color set with twelve reactive colors: black, gray, light blue, medium turquoise, turquoise, blue, red, pink, light scarlet, scarlet, golden yellow, and yellow. In some seasons it is important to print pastels, which are very light shades. Some fashions call for florescent shades. Further, pigments, especially "zincs", e.g., titanium whites can deluster a bright surface giving subtle contrast effects on satin fabrics.

Most legacy patterns, such as traditional flat colored figures can be printed from indexed, 8-bit RGB images where each color is represented by an index, which refers to a color look-up table. Each index represents a color in the look-up table where a row indicates the amount of ink to be printed in a colored figure by each bat indicated by the column in the battery. There are no overlapping colors in an indexed image. Half tones must be represented by more than one color or else dithered. Images with up to six colors can be pitched using a four-color ink battery.

More complicated tonal images can be printed from channel files, with one color per channel, where each channel drives a bat. The four-color channels are usually CMYK, and there is commercially available software, which will pitch CMYK colors. This four-color method is generally designed for a flat paper surface, and not suitable for the more complicated surface of a textile. Higher numbers of channels require special software to construct the channels and a very fast server computer with large memory and a very high-speed network (large bandwidth) to send the channels to the bats.

Printable surfaces, substrates or webs are generally conveyed to rotary print stations for sequential printing of different colors and inks. Synchronization of the print engines or print stations is manifestly important for correct printing. Synchronization of print engines is disclosed in the Hewlett-Packard patent and patent applications. Synchronization of rotary print stations in conveyed web printing is disclosed in U.S. Pat. No. 3,934,505, granted Jan. 27, 1976 to Kushner, a co-inventor herein.

However, with the present system, it is now not necessary to convert images into this type of CMY multi-color separations. The present system directly uses an RGB digital image for printing without a CMY transformation. The present invention eliminates the conversion of digital images into multi-color channels. This not only saves preparation time, computer processing and digital memory, but also simplifies the server serving of digital images to a series of single color print engines, and increases the speed of production.

It should be noted that while digital design RGB imaging now provides the majority of images made and seen today, there are still many textile effects and printing techniques which require chemistry which is generally incompatible with ink jet print engines such as cubic effect or "puff", metallic, khady (thick pigment), foil binders, pigment white, discharging chemicals such as rongalite and stannous chloride resists. These chemicals, including dyes and pigments, may be applied by rotary screen, while colors such as dyes and pigments may be simultaneously and complementary applied by ink bats in ink jet print engines. For instance, screens to surround photographs printed by ink bats may print complicated frames. Also, tints, thickeners and chemical coating may be applied first by an open screen to prepare the fabric for accepting the ink jet inks and/or screens may follow the bats to apply finishes or for coating to increase penetration for "double face" effect. The present system readily achieves diverse printing effects.

The ink bat of the present invention combines ink jet nozzles with a computer in a single color-printing device. The ink bat can be installed in the position of a rotary screen on an industrial textile printer. The ink bat includes a board or a beam, which spans the width of the substrate of fabric web. The print face of the ink bat is flat like a cricket bat. The ink bat face includes a nozzle matrix made from arrays of ink jet print heads or dies that are themselves arrays of ink jet nozzles. By way of example, the arrays could be HP Edgeline heads, or HP Scitex X2 heads. That is, the ink bat nozzle matrix may include dies and/or robust nozzles.

DESCRIPTION OF THE INVENTION

The term "printable substrate" as used hereinbefore and hereinafter means any substrate capable of being printed by an ink jet engine, and includes, by way of example, fibrous substrates including without limitation, textiles including a broad array of fabrics and the like, woven fabrics (e.g. Jacquard fabrics) and non-woven fabrics, and other fibrous substrates such as high fiber content papers.

Figure 12:
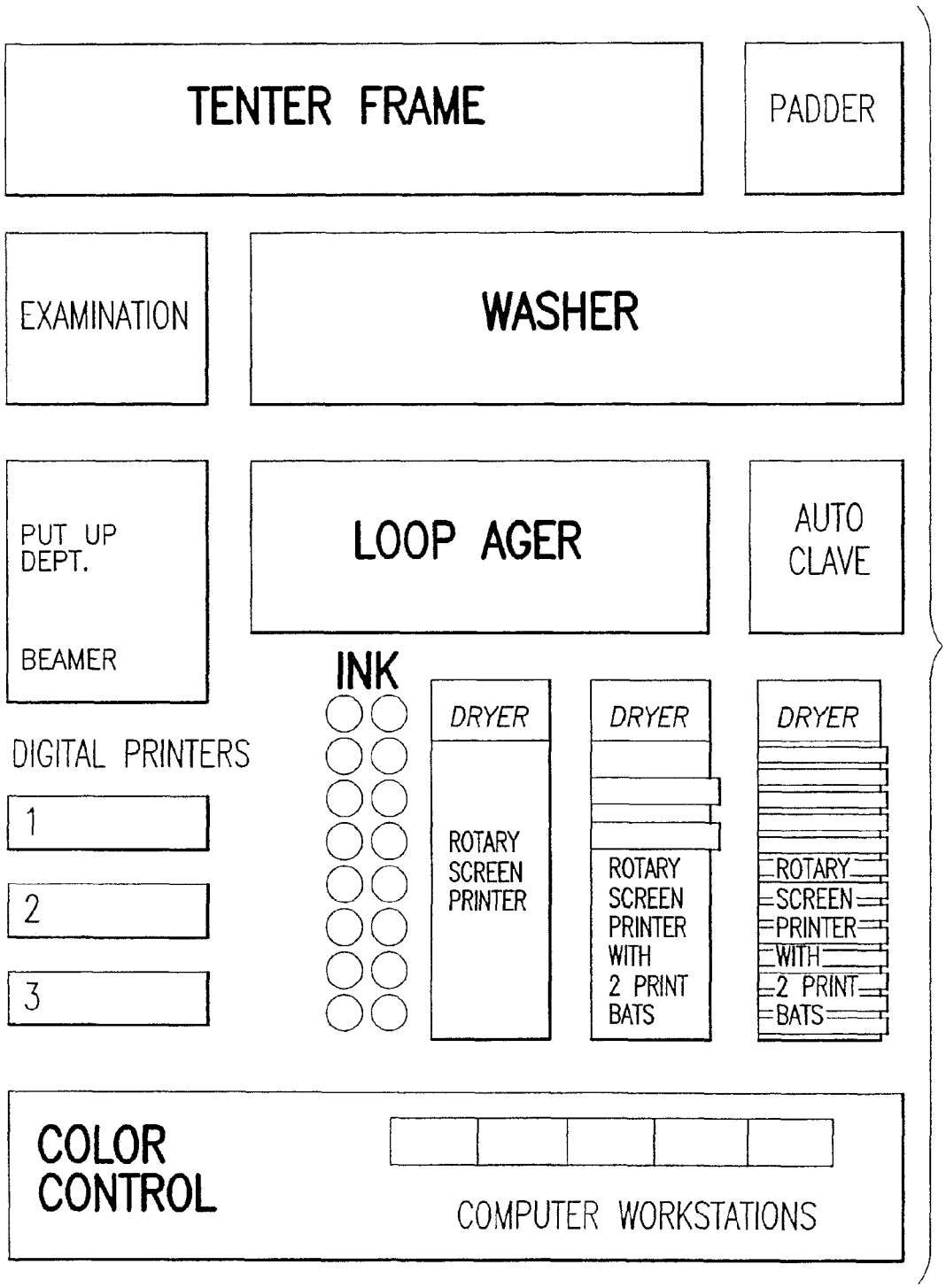
FIG. 12 is the floor plan for a rotary screen-printing plant modified to incorporate various inkjet print engines and digital color control.

This invention is a system for multi-color printing diverse substrates, particularly including textiles on an industrial scale. Textile printing involves wet printing water-based solutions of dyes onto a fabric, drying the fabric, steaming the fabric and then washing and framing the fabric, i.e., printing and finishing. In particular this invention converts or retrofits some or all screen print stations on a rotary printer to digital ink jet print engine stations. FIG. 12 shows the floor plan for an industrial plant converted for high-speed digital textile printing. The upstream rotary screen in operable combination with the array of ink jet print engines is one preferred embodiment.

The present system includes a modular ink jet print engine or print head assembly, which is also referred to herein as an "ink bat" which is similar to the assembly and print engines described U.S. Pat. No. 7,188,942 and US 2006/0120787, 2005/0185009 and 2005/0260021. A print engine may be mounted in place of one or more rotary screens with screen stretching mechanism and squeegee and color feed and color level control, on a rotary screen-printing machine. This combination of printing mechanisms provides for a universal textile printer, which can use screens or ink bats or both to print a broad array of patterns, traditional or digital or hybrid. The present universal printer can print diverse patterns and effects on diverse substrates on an effectively 24/7 basis, as will be further explained hereinafter.

Figure 1:
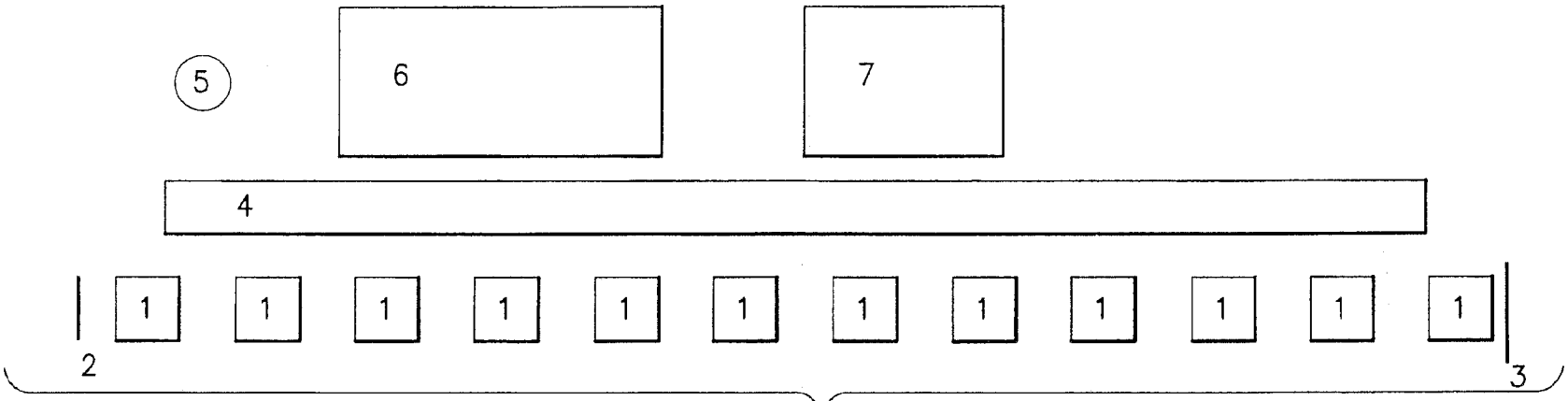
FIG. 1 is a schematic of an embodiment. The print engines are labeled 1. The seam detector is 2. The linear photo array is 3. The router is 4. The belt speedometer is 5. The image server is 6. The control station is 7. In the network #'s 1, 2, 3, 5, 6, 7 are all connected through #4. Other embodiments may have web or belt position encoders built into the print engines and avoid the need for 5. The numeration is similar in FIGS. 2-3.
Figure 2:
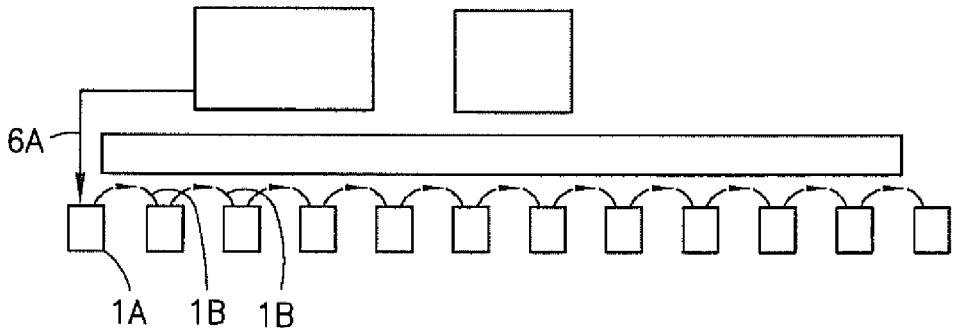
FIG. 2 is a schematic as in FIG. 1 showing the functional way the RGB image, or slice of the image travels. The first print engine 1A (shown on the left) receives a slice 6A from the server 6, where it is processed and passed 1B to the next print engine, where in turn it is processed and passed 1B to the next print engine, and repeated downstream. Meanwhile, the first print engine receives the next image slice. The succeeding slices in effect hop downstream across the array of print engines.
Figure 5:
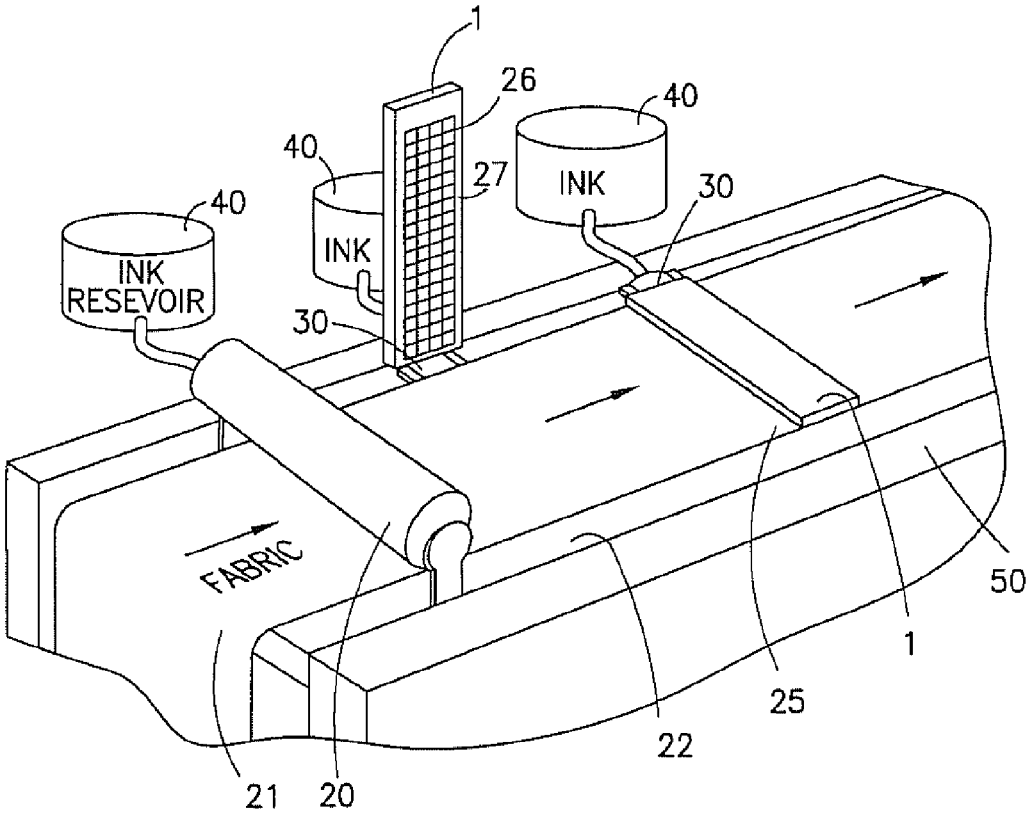
FIG. 5 is a perspective view of one embodiment showing the rotary screen in operable combination with the ink bats or print station. The face of raised ink bat includes an array of dies.

The print engines 1 can be mounted or retrofitted on a rotary screen print machine 50 and in place of the rotary screens. FIG. 5 shows a rotary printer 20 with print stations retrofitted to print with print engines (or ink bats). The retrofitted print engines synchronize with each other and with rotary screens printing on a substrate 21 transported by the belt 22. The system of printing stations includes digital print engines 1 whose output can be visualized and coordinated using an image server 6, a digital network and a digital control station 7. FIGS. 1, 2, and 5 show this in schematic and perspective views.

Figure 14:
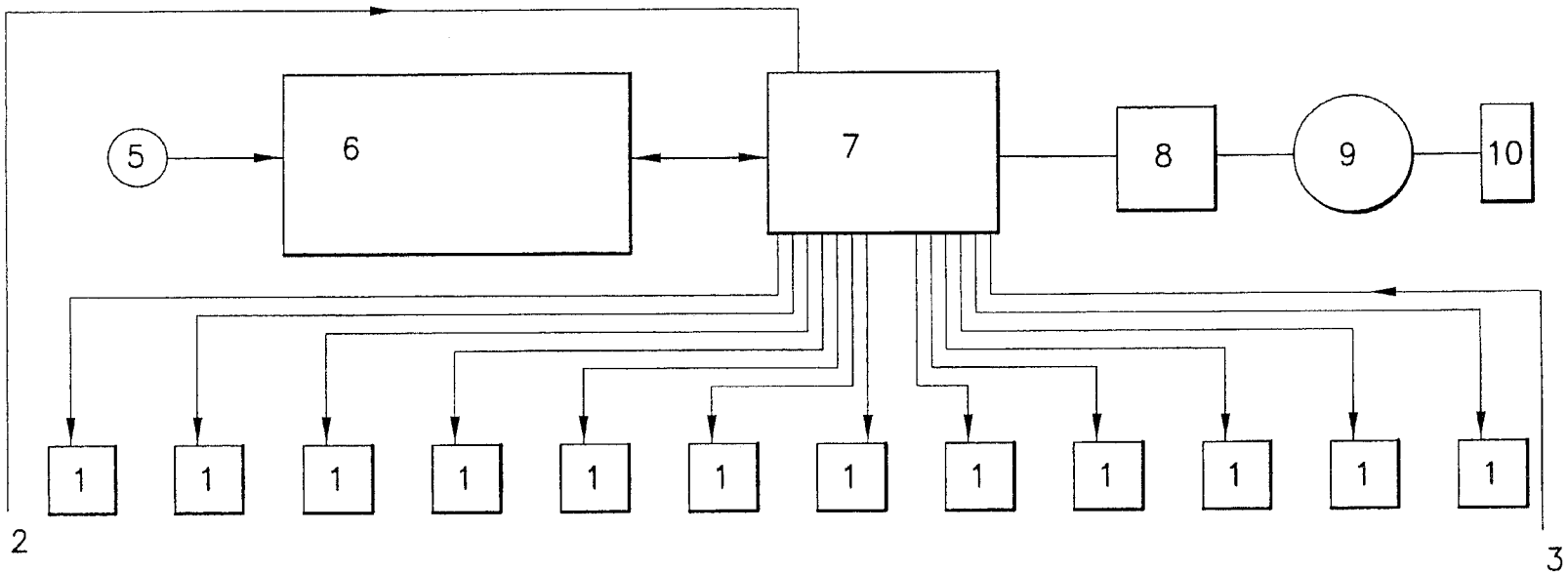
FIG. 14 is similar to FIG. 3 with addition of Internet portal 8 connected to control station 7. Remote color control station 10 is connected to main control station 7 though portal 8 and the Internet 9. RGB images on the Internet's World Wide Web are available for download to server 6.

The system also provides multi-color industrial textile printing production and also for short run sample production and to optimizing the production run for ultimate use. FIGS. 12 and 14 show optimizing the printing using a control station.

The system provides for printing multi-colored digital images with a series of single color print engines using an image server but without making a multi-channel color separation at or before the server but rather having each color print engine extract its own channel directly from the original RGB distal format image.

The system employs a seam detector 35, (FIGS. 1, 2, 3, 5, 6) upstream from the first print engine to detect the position of a seam in the web. After the seam, so as to limit or minimize wasted fabric, the jets may be primed to "wake-up" drying jets and "nozzle health" test marks may be printed so that the photo diode array downstream can detect broken nozzles and the appropriate nozzle substitutions may be initiated. A raising mechanism 30 may be incorporated in each print engine mount to jump the seam at the appropriated time as the seam passes under each print engine.

In another aspect, the system correlates information about printing parameters saved on a database with the finished textile, to enhance distribution and optimize printing for end use, and to provide feedback to further optimize future reprinting. FIG. 12 shows the printing, color control, and examining, areas which are tied together by the digital network.

The system of printing stations includes digital print engines (#1) whose output can be visualized and coordinated using an image server (#6), a digital network (router, #4) and a digital control station (#7) as shown schematically in FIG. 1.

In operation (FIG. 5), the ink bat faces downwardly over and across the fabric as at 25. The bat face is parallel to the fabric, the major axis of the bat, crossing the fabric at right angles. A rain of ink issues from the print head face 26 and makes colored patterns in the belt conveyed fabric. Each ink bat face is approximately 8 inches wide and 60 inches in length. The ink bat applies one color only and this may be any desired color. Each ink droplet is focused on a coordinate of the fabric with specific intention and precision. The ink can be a solution of one or more dyes in water.

The ink bat has an internal ink manifold with feeds to the print heads and has means to control the ink pressure. The ink bat has an internal computer and is networked with the other ink bats 1, an image server 6, a control station 7, a belt speed sensor and a fabric imaging photo array. The ink bat has external connectors for ink supply 40 (FIG. 5), communications (network) and power. The back or upper face of the ink bat has handles and hooks for mounting, removing, maintenance and storage. The ink bat has means to enable wash out and color change.

The ink bat has means for mounting in place of a rotary screen on an industrial rotary screen textile printer. In contrast to the rotary screen there is no contact between the ink bat and the web. Since inkjet print engines do not contact the fabric surface and therefore are not subject to contamination of "wet pickup", it is possible to print with inks in different engines that are incompatible in solution such as inks formulated with disperse dyes and those formulated with fiber-reactive dyes. This enables a system of inkjet engines to print both fibers in a blended polyester-cotton fabric or a wool-polyester union fabric.

There are means to elevate and lower the ink bat 30, and to control the height of the air gap between the bat face and the fabric web, to maintain a desired level and to jump over textile fabric seams. The ink bat has means to sense its position over the web, both in distance and height.

The ink bat has means to sense the speed of the web and may be synchronized with rotary screens, or other ink bats, printing on the moving web at the same time. Ink bats with different nozzle formations on their face, such as dies 2*b* and robust nozzles 27 (FIG. 5) for instance, different print heads, or varied array may be synchronized together. One or more rotary screens may apply an image to the fabric as it is simultaneously coordinated and synchronized with the image from one or more ink bats. One or more rotary screens may apply a coating to the fabric (as in FIGS. 5 and 6) that enhances the penetration and fastness properties of the ink being applied by an ink bat. One or more rotary screens may apply chemistry to enhance the image being applied by the ink bats, such as rongalite to discharge a dark fabric (make white) before applying color in the same coordinate with the ink bat.

Figure 3:
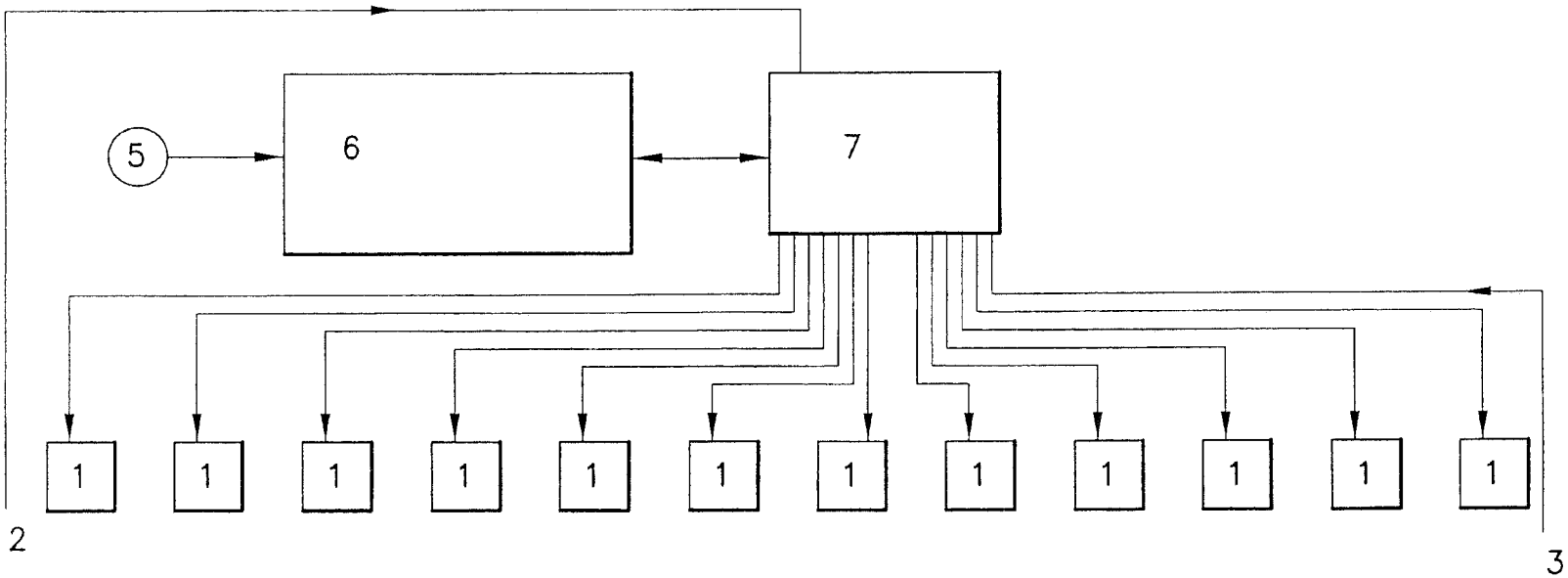
FIG. 3 shows the flow of information to and from the control station. Note, the control station may be fixed in place (hard wired) or may be a hand held (wireless) device or it may be remote. Images formed by the photo array are visualized at the control station. Color profile information comes from the server. Seam alert triggers come from the seam detector. Seam print engine maintenance routines come from the server. Selvedge image codes travel from the control station to the print engines. All data passing to and from the control station is copied to the server database.
Figure 13:
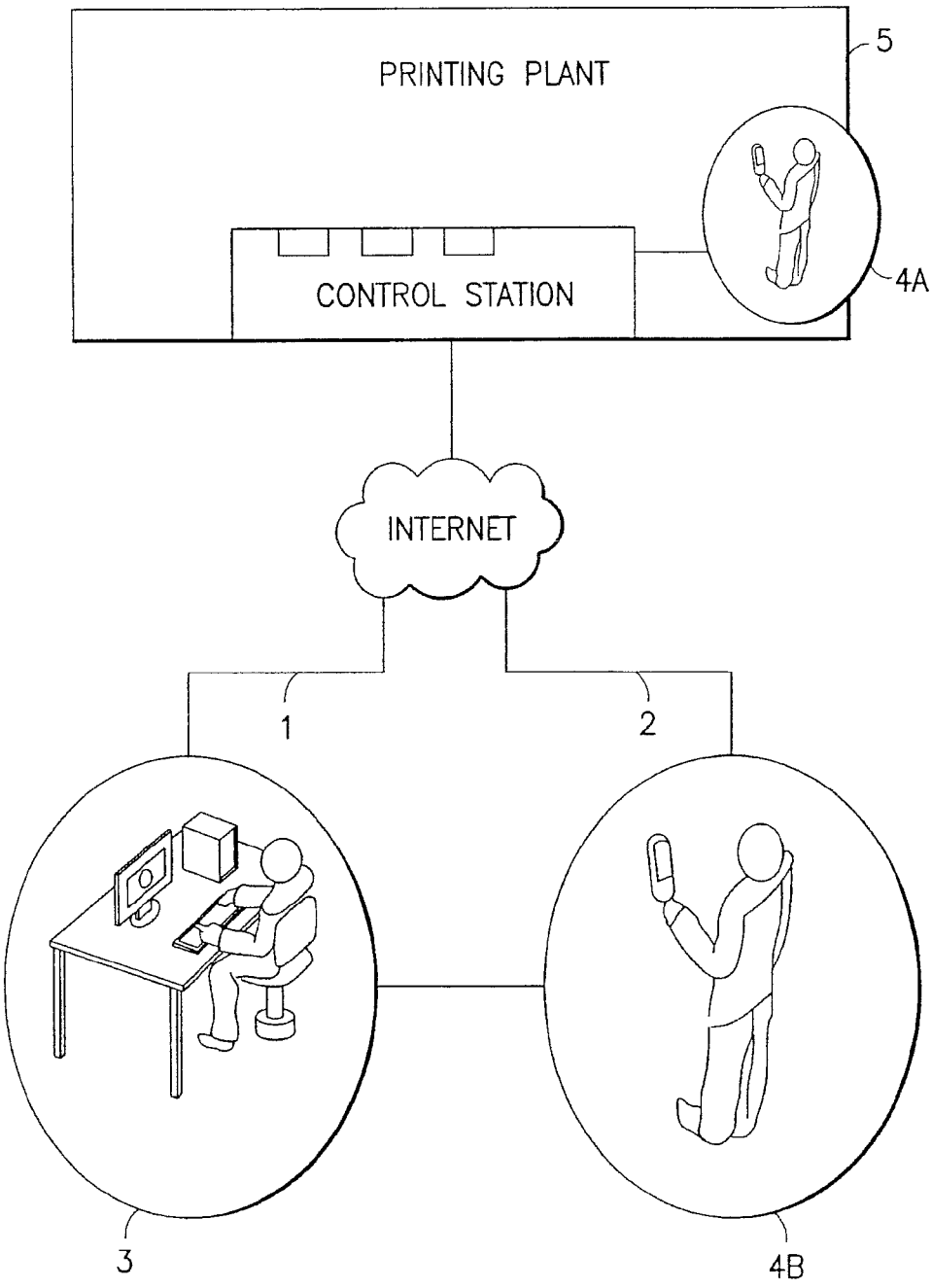
FIG. 13 shows remote control stations connected by 1 (ether network, internet, World Wide Web), to 5 print plants control station, and 2 by wireless telephone or wireless Internet, WiFi, etc. Remote control station 3 may be at artist studio, fabric converting shop, manufacturer, or couture designer. Hand held remote control station 4A is carried by printing machine operator or alternatively, remote client or key personnel (4B).

The server 6 may send color separations such as CMYK or Scitex multi-color channels to each bat. The server 6, however, preferably sends an 8-bit single channel color RGB image to each bat along with a color pitch, a color density look-up table to each bat so that each ink bat may extract the color information (i.e. its color channel) needed to print the ink for its part of the image. The server may also most preferably send a 24-bit three-channel color RGB image to each bat along with a color pitch (a series of color density look-up tables) to each bat so that each bat may extract the color channel it needs to print the ink for its contribution to the image. The server (FIG. 2, #5) may alternating send an RGB image (either 8-bit or 24-bit) only to the first bat (#1) which may extract its color channel and send the image to the next bat (#1) downstream which will extract its color channel and send the image to the next bat (#1) downstream and so on (FIG. 2). The present invention provides a cascade of image instructions to the array of print engines. A linear photo diode array (LPDA, FIG. 3, #3) is mounted after the last print station and sends a picture of the printed fabric to the control station (FIG. 3, #7). A human operator (FIG. 13, #4 A) views the picture from the LPDA on the screen of the control station and uses this picture to make instructional changes to the image being printed by the ink bats.

The control station 7 has means to adjust the registration of each ink bat. The control station has means to adjust the amount of ink printed by each ink bat. The control station has means to adjust the pitch or color profile of the image being printed (FIG. 3). The control station also has means to send narrow images to each bat to be printed on the fabric selvedge. These markings aid in registration and identify the image and the color profile. The actions of the control station take effect on the fabric being printed immediately starting with the first print engine when the control station so indicates and at the following downstream print engines at the same coordinate of the fabric as the first print engine.

All information input and gathered by the control station is stored in a database on a server (FIG. 3, #5) so that it may be reconstructed later, after the fabric is processed and examined (FIG. 12) so that it may be properly distributed and there will be constant feedback for further optimizing the job at its next printing.

On a high volume printer it is desirable to use standard colors so that changing jobs involves only sending a new job set-up instructions and a new image, not changing the ink in the print engines. This way it is possible to print one fabric with many small yardage jobs including strike-offs, head-ends, duplicates, and short orders quickly and efficiently, without wasting fabric and ink.

Figure 4:
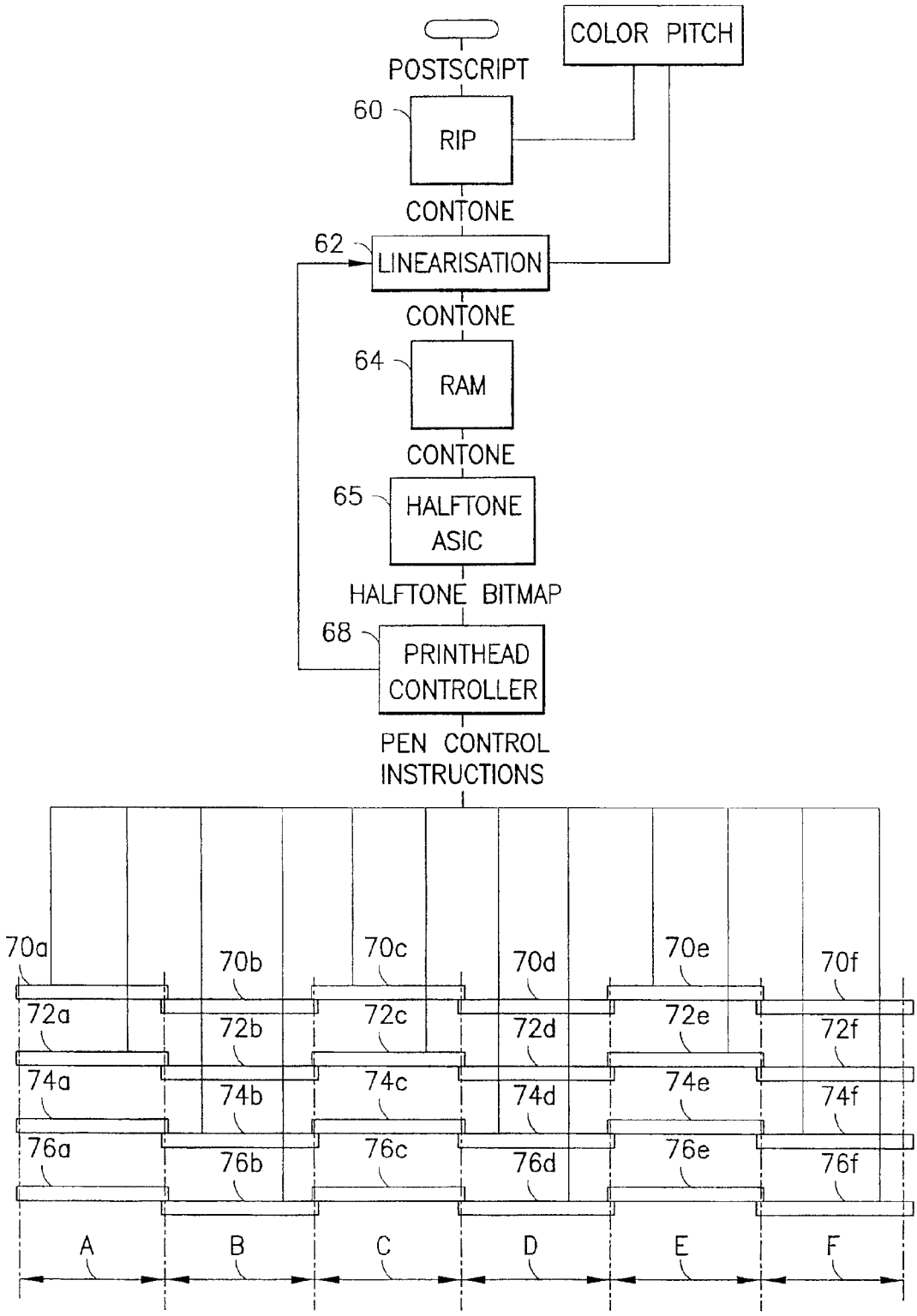
FIG. 4 shows the computer in the print engine and the processing pipeline. The RIP is where the RGB image is rendered into the contone for the ink color specific to the print engine. The RGB image emanates from the server. The pitch (or color profile) emanates from the controller or control station. The pipeline includes the linearization which can also be changed by the control station, the halftone ASC, which controls the dithering, the print head coordinator, and finally the dies with their nozzles from which the ink is applied.

Print engines or ink bats need broadband network connection through a router, to each other, and to an image server. This invention describes a method herein referred to as "bat hopping" (FIG. 2). Bat hopping minimizes the bandwidth necessary to print large, high-resolution images, as opposed to that described in Hewlett-Packard US 2006/0104396. The image is loaded into the ink bat from a digital image server FIG. 2, #5). Depending on size, the image can be loaded entirely, if ink bat memory permits, or streamed in slices. The image server and the ink bat are connected by and to a high-speed network switch (FIG. 1, #4) with 1000baseT wiring or optical cable or wireless). Data rates of 100 mB/s allow up to 3 yards/sec. for single channel or 1 yard/sec. for 24-bit RGB. The RGB source image streams from the server into the first ink bat in a print chain at the ink bat's request. A large amount of memory is required for buffering this transfer to allow for network and server-timing variations for the first ink bat, but in other ink bats in a print chain, this memory is used to buffer the stream until the precise moment the fabric coordinate arrives at that ink bat. Each ink bat in the chain (except the last) automatically sends the stream to the next ink bat in the chain instead of discarding it. This bat-hopping cascade (FIG. 2) allows for expansion of the number of ink bats (printing colors) without increasing the file stream server load. There are three types of color images used in textiles: 8-bit RGB, or "indexed", used for limited color, flat images (e.g. traditional textile images); 24-bit RGB, the most common type of digital image created by digital cameras, scanners, and monitors; and Scitex or multi-channel images with CMYK as its most common type used in paper printing. Bat hopping works with both 8-bit and 24-bit RGB images. In this manner of construction and operation, it is possible to print such images without first having to separate each image into individual colors channels at or before the server. The present system eliminates the need to first engrave a Scitex or multi-channel image. Bat hopping sends the RGB image to the lead bat and then the image hops downstream to the following bats, each bat extracting its channel from the RGB using auxiliary job-setup, "color pitch" or profile instructions (FIG. 4).

A linear photo diode array (LPDA) is operably disposed parallel to and downstream of the last printing station (FIG. 6) to visualize the printed image and to calibrate or register each color bat to any rotary screens, and to each other so as to change the amount of individual pixel colors (inks in real time, on the fly, with a control station incorporating a monitor and input device. This control station, which can be either local (FIG. 12, #4A) or remote (FIG. 12, #s3 and 4B), sends auxiliary job setup including color pitch instructions to the bats, so that each image may be optimized for print-head efficiency, fabric and end use for artistic and commercial purposes at the beginning of a print run with test "strike-offs", or during a print run when the substrate or end use changes, or to compensate for noticeable print-head operating inefficiency.

The optimization may be for illumination at point of sale, theatrical effect, or photography, or video, or artistic display, or for matching or coordinating colors with fabrics or accessories produced by a different process under agreed lighting conditions.

The control station has a global clock display and the new pitch is sent to the first bat on trigger, which may be activated by voice, or by mechanical device such as a wand or a button, or by an optical detector located before the first bat to signal changes in the media. The new pitch or profile becomes active in the following bats when the newly changed image from the first bat falls under each of the following bats.

The new pitch or profile may be loaded from previously determined setup made either offline or on-line and save in a database (FIG. 3, #6). Alternatively the new pitch may be determined on-line in real time using the scanned image displayed on the control screen (FIG. 12) and sent into action.

A code may be printed on the fabric selvedge either a bar code or an alpha numeric symbol, imposed in the image stream and all information gathered and sent—clock, scanned image, pitch, and codes is correlated and saved to a database for referral and analysis after printing and processing to further improve image quality in subsequent print runs.

Pitch information from previous runs or offline static setup or analysis can be sent to the printing or ink bats with possible restrictions on pitch parameters, certain controls may be locked or unlocked for real time activation.

The pitch or color profile data from previous jobs is available from the database and may be activated during printing. Thus the printed multi-color image may be improved, before, during and after printing.

Tick marks for registration, such as raster register marks as disclosed in US 2005/0185009 may be printed outside the fabric selvedge directly on the fabric support or conveyor belt to be washed off on the belt return, wherein the bats and optical scanner should be slightly wider or about a centimeter than the fabric but narrower than the belt. These marks may be analyzed automatically and raster correction applied, or the image may be visually inspected and corrected with jog control at the control station, with raster improvement sent to individual bats, thus allowing for perfect registration or imperfect effects sometimes said to "add dimension". The rotary screen registration may be mechanical or electrical digital synchronization for rotary printer as described in U.S. Pat. No. 3,954,506.

Figure 6:
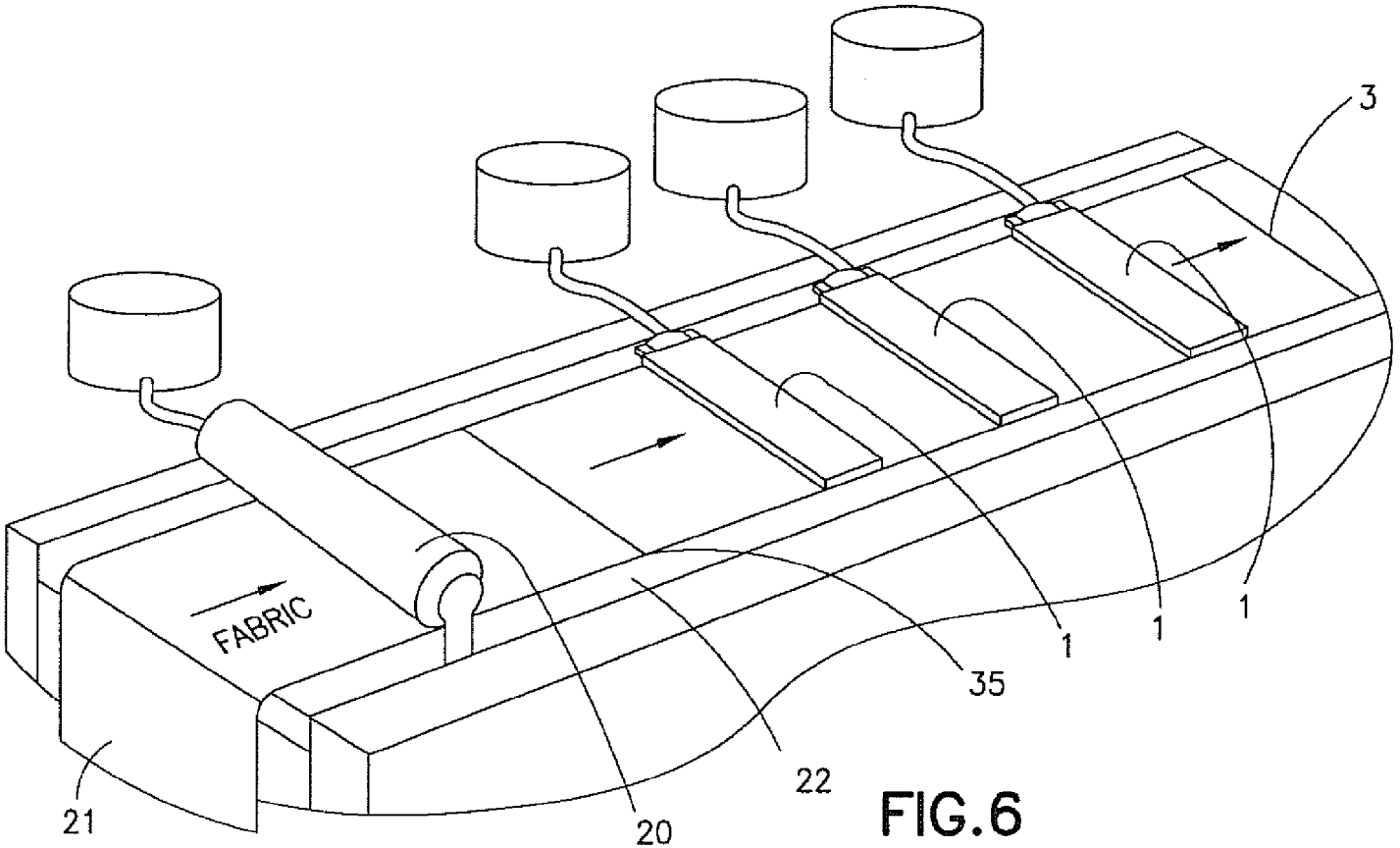
FIG. 6 is a perspective view as in further combination with the linear photodiode assembly (LPDA).

Near seams or imperfections detected by the optical detector before the first ink bat, or on command trigger from the control station, print head calibration may be performed as described in published US2004/007509 using the linear photo array (FIG. 6, FIG. 3, #3). The calibration marks are made near seams and imperfections to leave long lengths of perfect printed fabric for subsequent fabric cutting.

Figure 15:
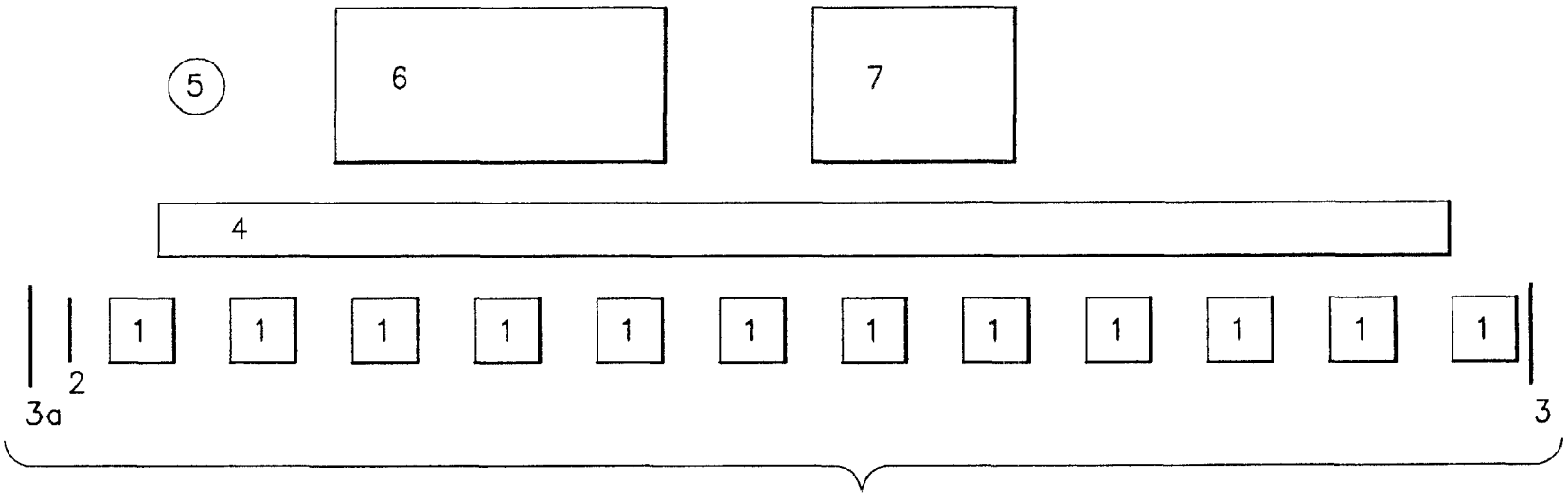
FIG. 15 is similar to FIG. 1 with addition of a second LPDA 3*a*, upstream the print engines. This LPDA images the incoming unprinted fabric for re-mapping the image being printed to the fabric. Thus the system can integrate pre-existing fabric patterns into the printed fabric.
Figure 16:
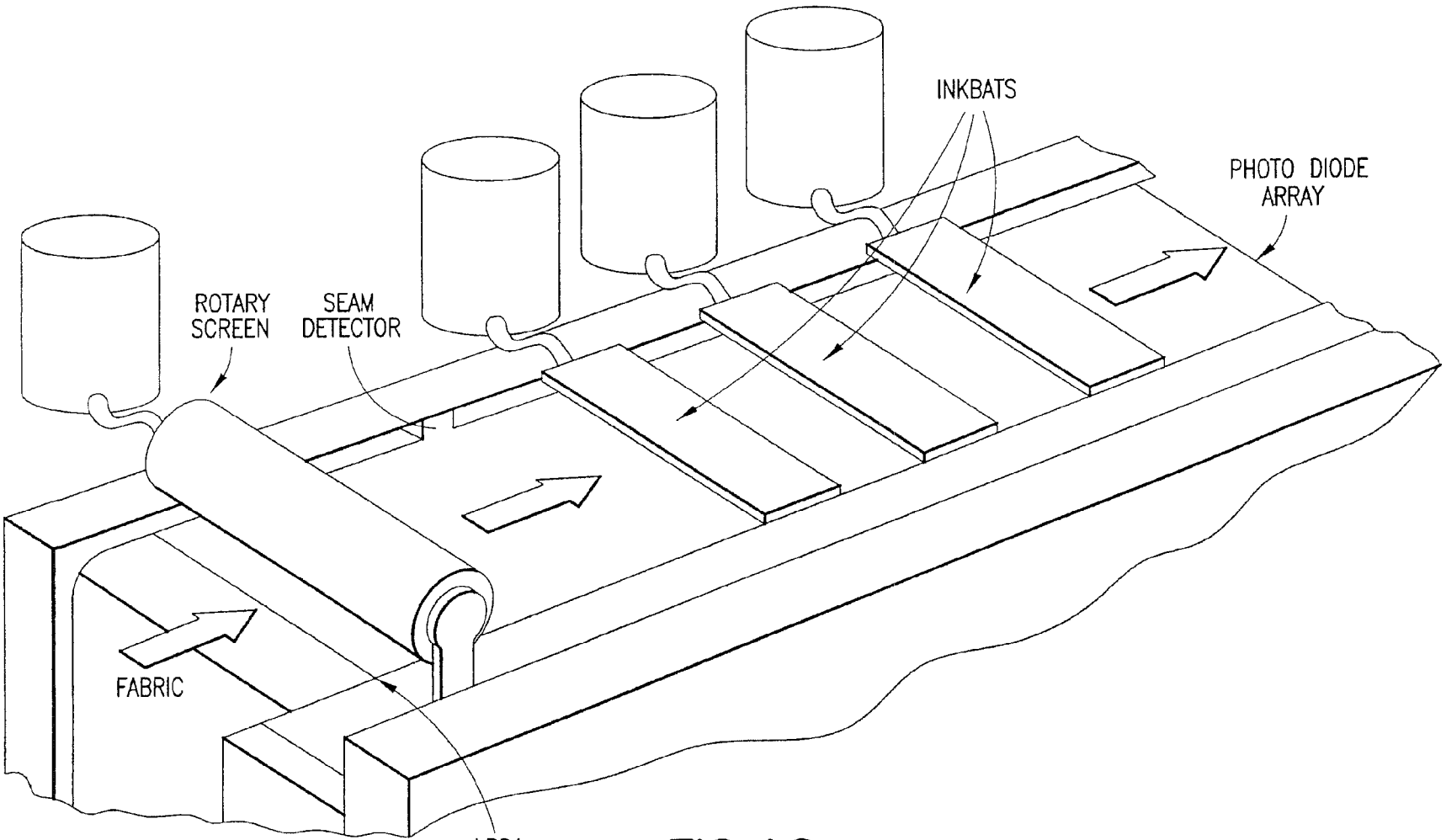
FIG. 16 a perspective drawing similar to FIG. 6 further showing the second LPDA, which is mounted upstream the print engines. The upstream LPDA images the geometry of unprinted fabric and/or any pre-printed image.
Figure 17:
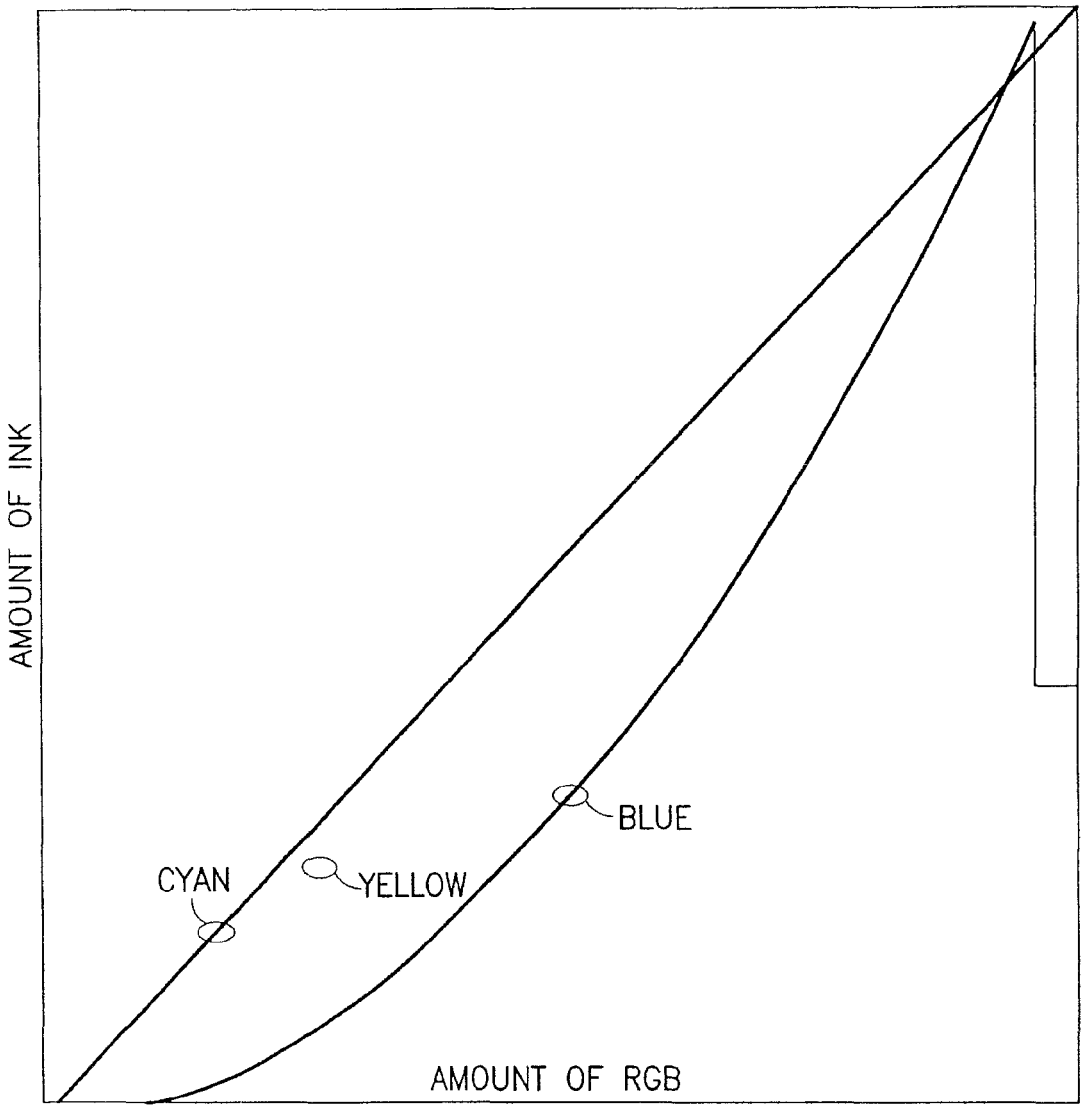
FIG. 17 is an L12 (at least 12 colors) mix of hue curves for providing art quality commercial printing on diverse substrates.
Figure 18:
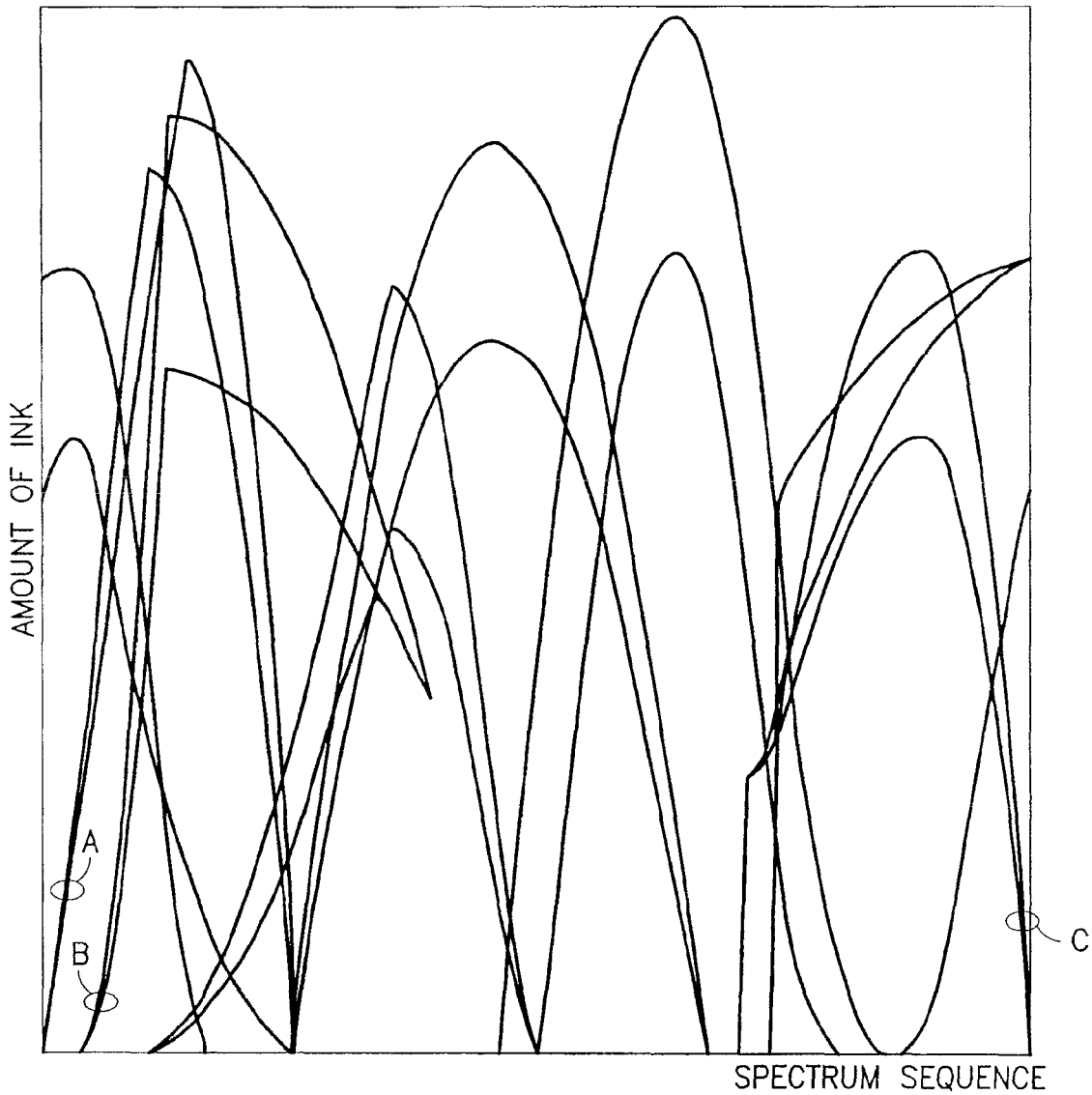
FIG. 18 is an L12 (at least 12 colors) series of the graph of the hue curves used in conjunction with the printing quality achieved as shown in FIG. 17.

There may also be a second linear photo diode array (LPDA as in FIG. 16 and FIG. 15, #3*a*), upstream from the first print engine, to detect patterns in the fabric that come from Jacquard weaving or knitting or embroidery or previous printing, so as to synchronize the pattern being printed with the existing pattern in the fabric. This requires first comparing the input image from the LPDA with a congruent mapping of the fabric image and the image to be printed, and thereby mapping the image being printed onto the patterned fabric.

The RGB RIP

Figure 7:
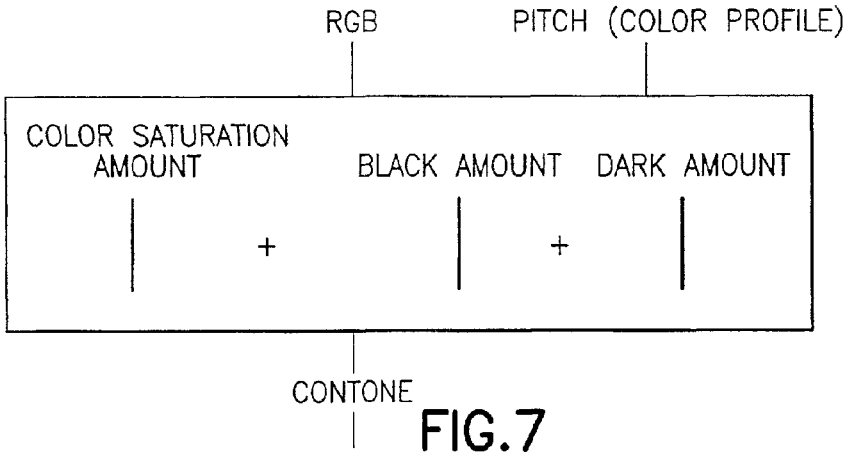
FIG. 7 shows the RGB rip for the print engine with RGB image input and Pitch (Color Profile) instructions input. Color separation (channel) for specific color print engine is output as contone for further processing in pipeline of FIG. 4. The pitch has parametric instructions for the controlling the color saturation amount (as in FIG. 8), the black amount FIG. 9, and the dark amount.

A print engine extracts the channel information needed for printing from the RGB slice using the job setup information developed off-line, prior to printing for the image. The print engine's raster image processor or RIP processes each RGB pixel by deconstructing (FIG. 7) it into color saturation and black amounts and sometimes also an additive correction, the "dark" amount. The print engine's channel color for a pixel is the sum of the color saturation amount, and the amount of color in the black and the dark in the RGB pixel (FIG. 7). This total amount is then calibrated (or linearized) for the specific ink, the jets condition, and the fabric (FIG. 4).

Figure 8:
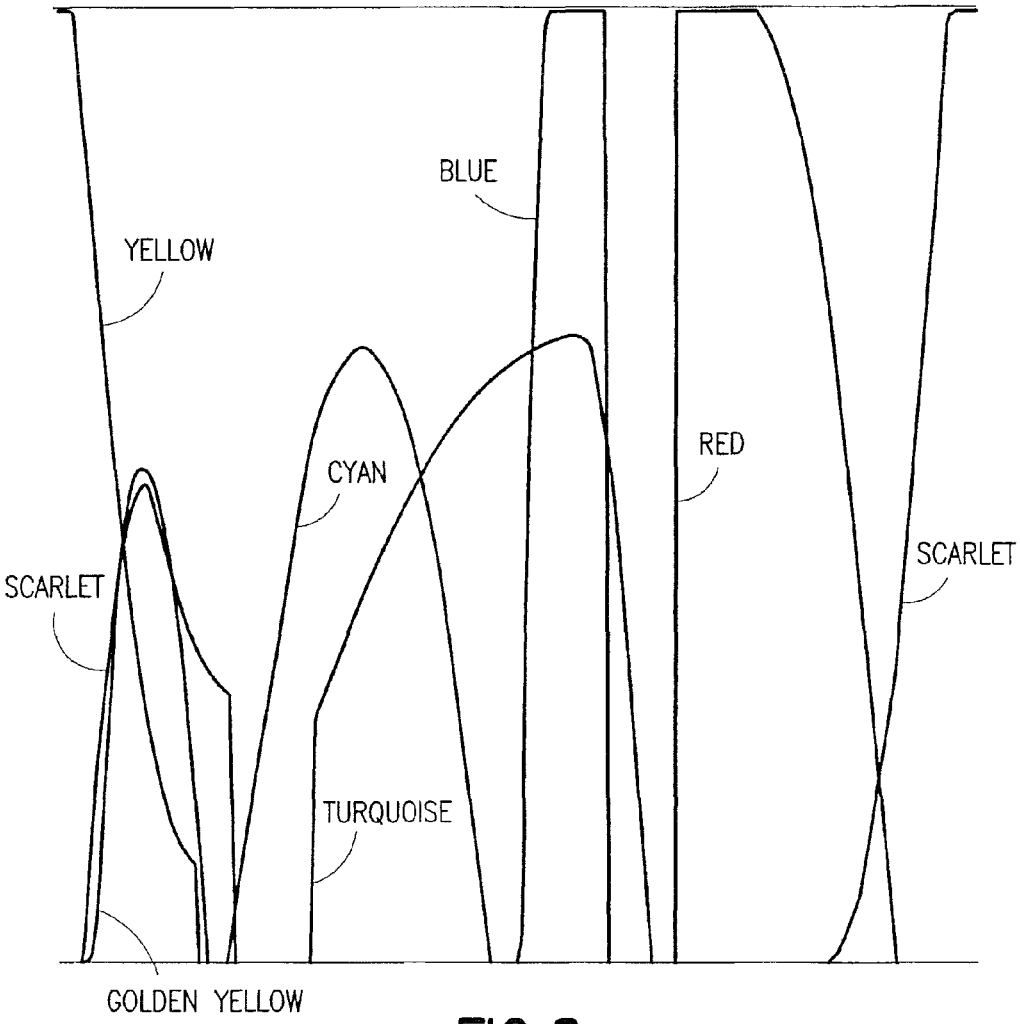
FIG. 8 shows hue curves. X-axis is the hue line left curve is scarlet then golden yellow, yellow, cyan (med turquoise), turquoise, blue, red, and again scarlet overlapping. Y-axis is color saturation amounts for the various inks and mixtures.
Figure 11:
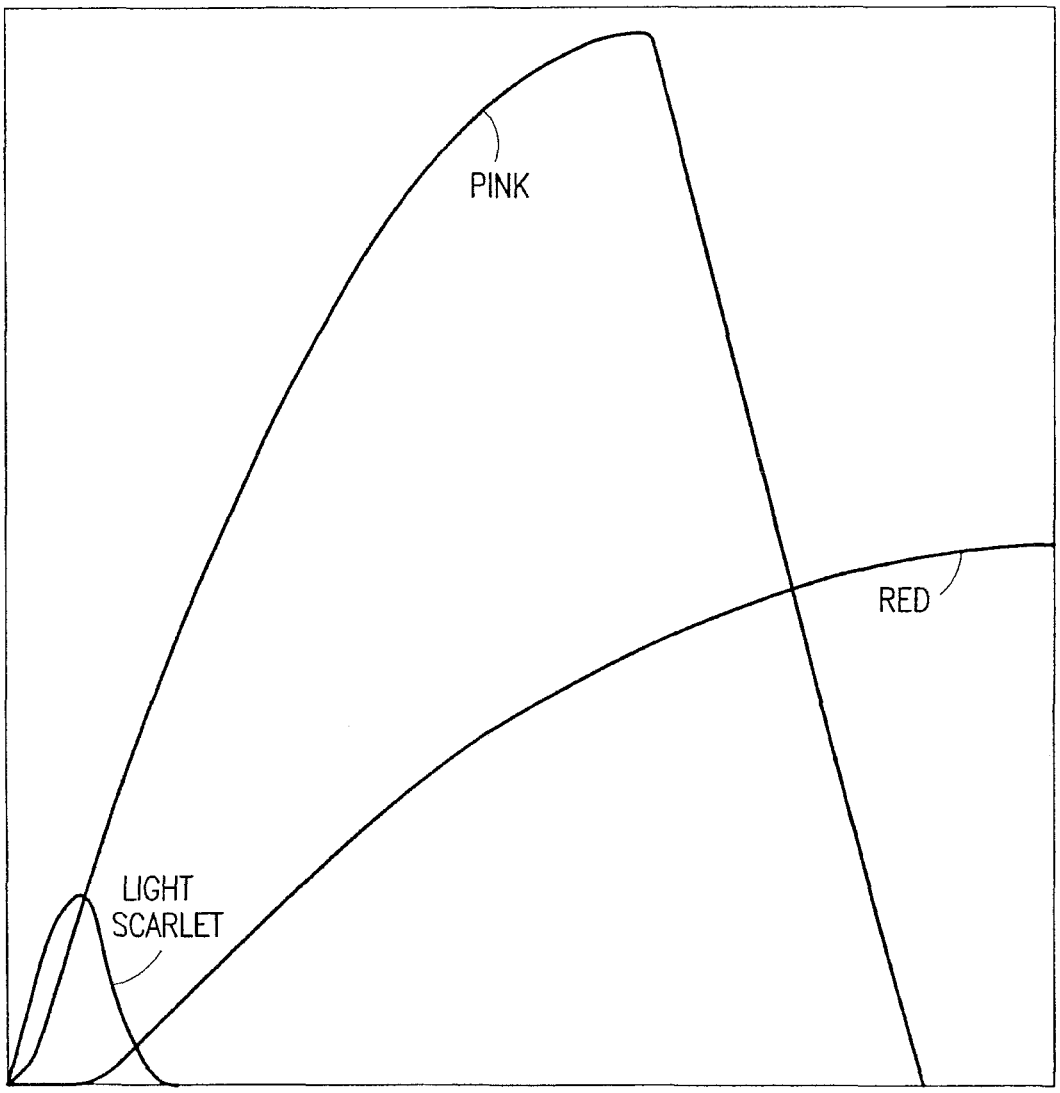
FIG. 11 shows the red mix curve where small curve at left is for the light-scarlet ink print engine, the curve which peaks in the middle is for the pink ink print engine, and the rising curve that starts in about 10% along the input line (x-axis) and peaks at the right (full input) at about 50% on the output is the red ink print engine

Opening up the artist's color wheel and laying its circumference flat, yields the RGB hue line. The saturation amount for an RGB pixel is determined from the height of the ink solution curve for the print engine's color located at the pixel's RGB hue line coordinate (FIG. 8), times the largest of the RGB triad minus the smallest of the RGB triad, plus the amount indicated by the height of mixture solution curves at that coordinate which contain the print engine's ink color. FIG. 11 shows a red mixture with curves indicating amounts for light scarlet, pink and red ink.

Figure 9:
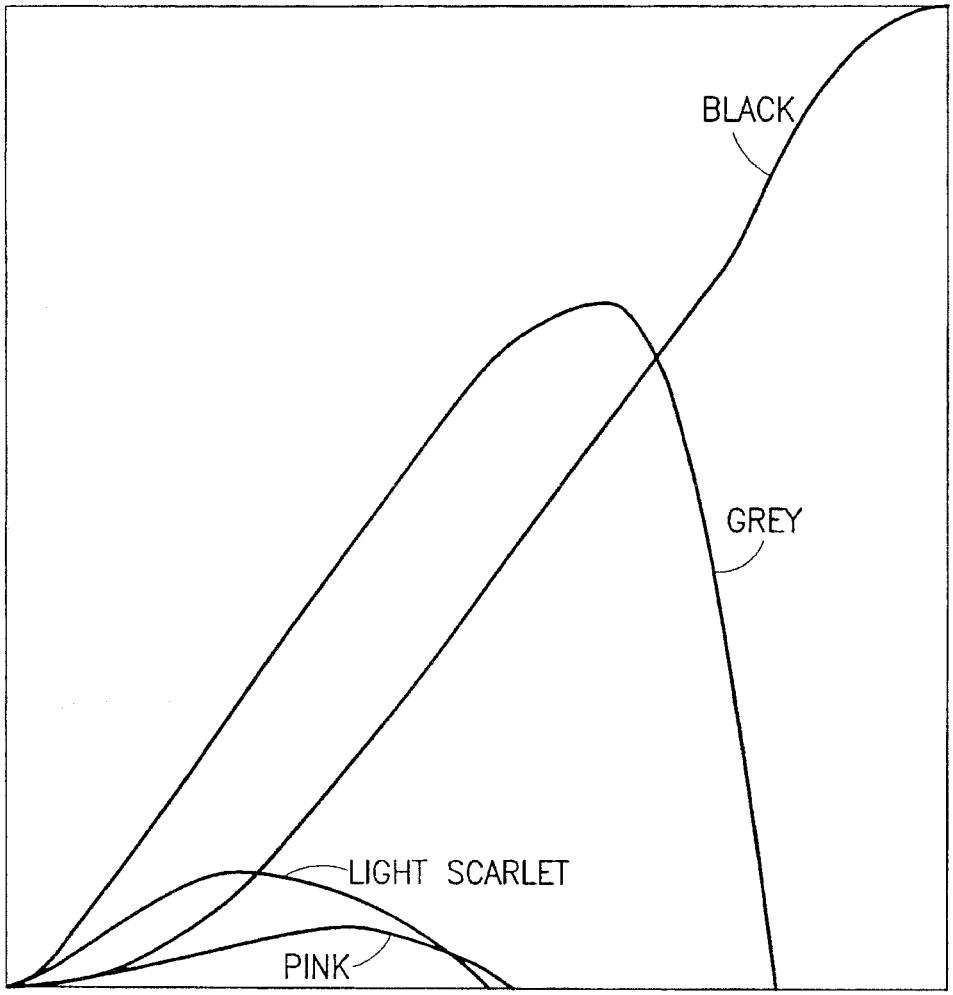
FIG. 9 shows the black amount on the x-axis and the various inks' output amount for a pixel. X-axis is input, y-axis is output.

The black amount is determined by the reverse amount of the greatest component of the RGB triad for the pixel, times the height of the black curve for that ink bat. (FIG. 9 shows black curves for four bats) This is a very standard "HSL"

lightness calculation except it is reversed for black as disclosed in (See U.S. Pat. No. 6,588,879), which reference is incorporated herein in its entirety by reference thereto.

There are a few useful approaches to darkening which supplements black. "Deepening" works by spreading the pixels hue coordinate over several adjacent shades. "Complimentary Darkening" uses a complimentary hue table.

A print job is set up off line, using the Colorist's Previewer and Specifier. This software lets the art/colorist choose his/her pure inks and mixtures and set them as curves on the hue line and the black and dark spaces, while previewing the results. The Specifier uses polynomial easing to draw the color curves. The Specifier also has global contrast settings (gamma) for color saturation, black amount and dark. The present system prints directly from an RGB digital image without a CMY transformation.

Linearization

Figure 10:
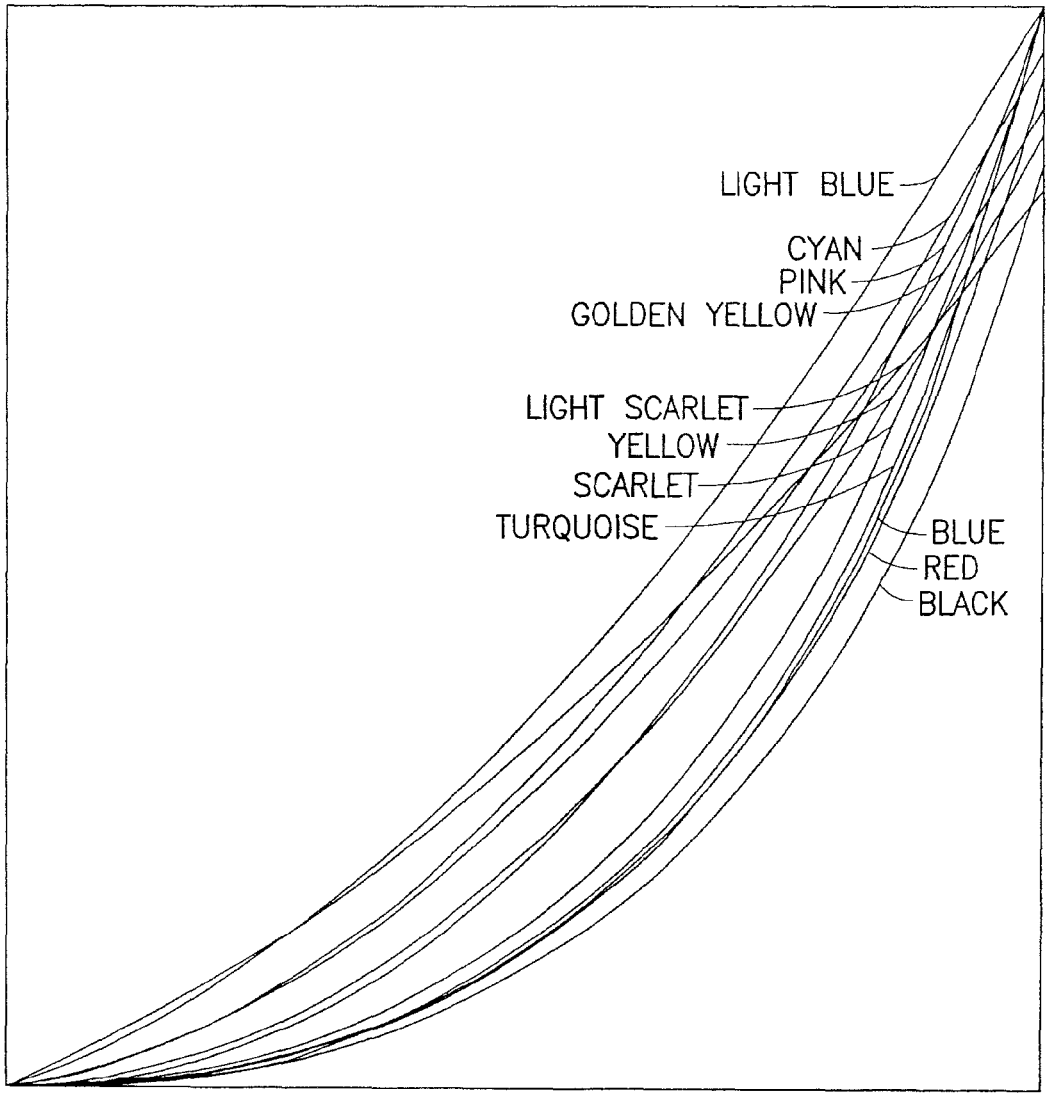
FIG. 10 shows Print Engine Calibration Curves (Kubelka-Munk). These are ink profile tables for eleven print engines (identified by ink color). X-axis is input. Y-axis is output. Each curve is derived from Kubelka-Munk parameters determined by measuring RGB values of printed calibration ramps.

The ink application of the print engine on the specific fabric is calibrated and standardized by printing and measuring the image of a color wedge or ramp and then adjusting for linearity. The Kubelka-Munk equation provides a good smooth first approximation to linearity. (FIG. 10 shows the calibration profiles for eleven inks; these curves are derived from parametrically fitting the Kubelka-Munk equation to the RGB scanned values of printed color ramps) A 16-bit empirical color table may give even better linearity. Of course, all fabrics must be processed, That is, steamed, washed and framed before measuring with a digital color scanner (In FIG. 12, the Loop Ager and the Autoclave are for steaming the fabric; the Washer is for washing the fabric; and the Tenter Frame is for framing. Measurement with digital scanner is made in the Color Control Room.)

One most preferred aspect is the combination of the afore-described system with upstream means for optically visualizing the geometry of and any pre-printed image on the substrate, with cooperative means too providing modifying instructions to the ink jet print engines. One upstream viewing assembly useful with the present invention is shown and disclosed in U.S. Pat. No. 6,792,865 and US2005/0611386, which references are incorporated herein in their entireties by reference thereto. The foregoing combination of assemblies provides a universal multi-color printing system, which is operable in effect on a 24/7 basis. By way of example, a change of substrate from a certain textile to a Jacquard fabric with a change to different printing effects may be readily achieved with minimal downtime.

The present invention contemplates the cooperative and complementary use of a broad array of inks and dyes in the ink jet print engines and rotary screen. The combination of and acid dyes and fiber dyes are specifically contemplated.

The conveyor belt useful in the present invention may be constructed of a broad range of materials including polymeric, as well as reusable backing substrates and fabrics, such as disclosed in US2004/0244621, published Dec. 9, 2004 which reference is incorporated herein in its entirety by reference thereto.

Improvements in Ink-Jet Printing

The following are further features and improvements to achieve art quality commercial multi-color printing on diverse substrates, particularly blended fabrics.

1. Choice of preview resolution. 1) Everyday—smooth—"load tables and parameters (use dll)", 2) Tight situation—dithered—("use L12").
2. Deepening blurs position on hue line and (like black) uses least of RGB triplet.
3. Mix allows curves of "hue curves" be a mixture of primary inks (which are also referred to "slot colors").
4. Use of a smoothed 16-bit profile curves instead of Kubelka-Munk approximation.
5. Two levels of mixture curves. The first level (prime mixtures) develops styles of colors, which are used in many different images. At the second level the secondary mixtures are made from the primary mixtures and inks.
6. A darkening effected with a novel complementary hue table where the complementary (user defined) darkening shade is made from primary colors and (novel) complementary mixtures.
7. Instead of three channels (R, G, B) input with an output of 12 channels, the new improved input would include spot color channels along with the RGB. The spot color channels would be 8-bit mixtures, controlled by mixture tables.
8. When making a profile record the (simultaneous) slot colors are at the same time.
9. Make the mixture channels switchable in the preview. This permits one to view the effects of the channel, by itself.
10. Capability to switch off a curve or channel in the preview (i.e. to preview it's effect)
11. Multiple hue tables for Multiple (coincident) Ink sets. This allows printing of blended fiber yarn and union fabrics. This requires a high number of slots. Each ink set would be specific to a fiber of the above blend. Blended fabrics are the most popular and have comparative advantageous properties.
12. The foregoing provides improved printing effects, such as discharging colored inks or discharging (clear) solutions. Discharge means printing on dark grounds that are made light by the application and processing of a discharging ink or solution. The novel discharge ink technology when used in combination with robust heads, namely the Scilex® Aprion® print heads, provides print-through effects not common to ink jet printing. That is, ink jet printing would have desirable ink print-through consistent with rotary or flat screen-printing.
13. L12 contemplates the inclusion of Virtual Slots to allow the reorganization of the printing order of the inks.
14. Calibration (scan strips) are built into every run. The only way to do this with current DLL is to prepend onto an input image.
15. Scanner readable ID is built into every run—bar code, machine-readable containing information file.
16. Flow page—window calculator. Enter RGB, and Flow Page shows progression of RGB values thru hue mix to separations to preview.
17. Unified single file format for sst (+redo dll).
18. Standard Release RIP DLL (for developers of other packages.
19. Standard Release user interface DLL (for developers of other packages)—different levels of access.
20. Photoshop Plug-in for UL and RIP.
21. Undo levels (this permits one to backtrack while creating a profile)
22. "Tad At A Time"—records every production run with parameters and resultant scan:
    i) calibration levels on every run (see above);
    ii) readable ID (see above);
    iii) undo levels (see above);
    iv) single file format (see above);
    v) recording of client requests/job statements;
    vi) scanning and logging of each run "header";
    vii) run reporting with simple differentiation analysis reports; and/or viii) job progress reports with comprehensive information (available via web).

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed is:

1. A multicolor print system for printing a multi-color image on a substrate comprising:

a printable substrate;

an array of ink jet printing engines for printing a color component of said multi-color image;

a rotary printing station for printing a color component of said multi-color;

a conveyor for conveying the printable substrate with respect to the ink jet print engines and the rotary printing station;

said rotary printing station being disposed upstream of the array ink jet print engines;

further comprising a server for providing instructions to the ink jet print engines;

wherein each print engine extracts from the server instructions specific to the respective ink jet printing engine, and wherein the ink jet print engine specific set of instructions are cascaded downstream across the array of ink let print engines; and wherein the server comprises a digital image server further comprising a router, each said ink jet print engine comprise an ink bat being connected to the router and to each other said ink bat and to the digital image server, whereby the image is loaded into the respective ink bat from the digital image server, wherein the image is streamed in slices so that a slice of each set of print engine specific set of instructions provides for bat hopping printing of the image on the substrate, whereby the ink jet print engines and printing stations print respective color components for printing a multi-color image on the substrate.

2. The multi-color printing system of claim 1, each ink bat, except the last downstream, automatically sends the streaming instructions to the next in turn downstream ink bat to provide the bat hopping printing of the image on the substrates.

3. The multi-color printing system of claim 1, wherein each said ink bat extracts channel information for printing from an RGB slice of said instructions.

4. The system of claim 1, each ink jet print engine comprises a raster image processor for processing each RGB pixel by deconstructing the pixel into color saturations and black components.

5. The system of claim 4, further comprising a linear photo diode array disposed parallel to and upstream of the array of print engines and the rotary printing station for visualizing the pixel image and calibrating to each ink jet print engine and the rotary screen printing station with respect to each other so as to on the fly change the individual color pixels.

6. The system of claim 5, further comprising a control station being operably connected to the ink jet print engines, rotary screen printer and linear photo diode array.

7. The system of claim 5, wherein the substrate alternatively comprises a textile and a Jacquard fabric.

8. A multi-color printing system for printing a multi-color image on a substrate comprising:

a printable substrate;

an array of ink jet print engines in parallel disposition for printing a multi-color image;

a conveyor for conveying the printable substrate with respect to the ink jet print engines;

a digital image server, each said ink jet print engine being connected to the server, wherein ink jet engine specific respective image the instructions are loaded into the ink jet engines;

wherein image printing instructions are streamed in a slice-by-slice manner across the array of ink jet print engines to provide hopping printing of the image.

9. The system of claim 8, said slice comprises an RGB slice, and wherein each ink jet print engine extracts channel information from an RGB slice for printing the image without a CMY transformation.

10. The system of claim 9, further comprising a rotary printing station disposed upstream of the ink jet printing engines for printing a color component of the multi-color image.

11. The system of claim 8, further comprising a linear photo diode array disposed upstream of the ink jet print engines, and said linear photo diode array being operably connected to the server and in turn to the ink jet print engines.

12. The system of claim 11, further comprising a rotary printing station disposed upstream of the ink jet printing engines for printing a color component of the multi-color image, and said linear photo diode array being disposed upstream of the rotary printing station.

* * * * *